US005135417A

United States Patent [19]

Stanevich

[11] Patent Number: 5,135,417

[45] Date of Patent: Aug. 4, 1992

[54] DUAL USAGE ELECTRICAL/ELECTRONIC PIN TERMINAL SYSTEM

[75] Inventor: Kenneth W. Stanevich, New Baltimore, Mich.

[73] Assignee: Augat/Altair International Inc., Clemens, Mich.

[21] Appl. No.: 724,754

[22] Filed: Jul. 2, 1991

[51] Int. Cl.[5] ..... H01R 13/00

[52] U.S. Cl. ..... 439/851

[58] Field of Search ..... 439/851, 852, 856, 857, 439/861, 862, 886, 887, 924

[56] References Cited

U.S. PATENT DOCUMENTS

| | | | |
|---|---|---|---|
| 2,539,230 | 1/1951 | Craig | 439/857 |
| 3,862,792 | 1/1975 | Jayne | 439/851 |
| 4,002,400 | 1/1977 | Evans | 439/851 |
| 4,283,108 | 8/1981 | Fischer | 439/857 |
| 4,734,041 | 3/1988 | Bruchmann et al. | 439/924 |
| 4,832,614 | 5/1989 | Jenkins | 439/188 |
| 4,971,580 | 11/1990 | Ward et al. | 439/595 |
| 4,984,998 | 1/1991 | Duncan et al. | 439/352 |

*Primary Examiner*—Joseph H. McGlynn
*Attorney, Agent, or Firm*—Weingarten, Schurgin, Gagnebin & Hayes

[57] ABSTRACT

An exemplary terminal system comprises a pin-receiving member having a lead-in for receiving a pin-shaped contact, a signal transfer zone located a first distance from the lead-in, and a power transfer zone located a second distance from the signal transfer zone. The signal transfer zone is preferably defined by opposed bumps plated in gold. The power transfer zone is preferably annular in cross-section, so as to present a large contact area, and tin-plated. The system is therefore useful for either signal transfer or power transfer applications.

22 Claims, 4 Drawing Sheets

DUAL USAGE ELECTRICAL/ELECTRONIC PIN TERMINAL SYSTEM

FIELD OF THE INVENTION

The present invention relates to electrical connectors, and in particular to a terminal system for both power-carrying and signal-carrying applications.

BACKGROUND OF THE INVENTION

Circular or barrel terminal systems for carrying moderate to high electrical current are known. These systems are typically used in automotive multi-pin harnessing systems to convey electricity to fans, power windows, power locks, lights, and other electrical devices.

As shown in the sectional views of FIGS. 1 and 2, prior art connector systems involve male pins and cooperative pin-receiving members mounted within respective plastic housings which mate together. Each of the respective plastic housings contain a plurality of channels for receiving male pins and corresponding pin-receiving members. The male pin member is comprised of a pin connected to a narrow or "neck-down" region conformed for cooperative engagement with a locking finger disposed within the channel of the plastic housing. The pin member neck-down region is connected in turn to crimping tabs; one opposed pair of crimping tabs are crimped around the wire, and another pair are crimped around insulation and/or around environmental seals made of elastomer or rubber.

The pin-receiving member of the prior art connector assembly, as shown in FIGS. 3 and 4, comprises pin-receiving contacts, a similar narrow or neck-down region conformed for cooperative engagement with a locking finger of the respective plastic housing, and two sets of opposed crimping tabs, one set for crimping the wire and the other for crimping insulation and environmental seals. The pin-receiving contacts are cylindrical in shape and formed out of a stamped piece of metal. The connector has opposed tinned contact beams for receivably engaging the pin. A shroud tube or sleeve is used to protect the outer ends of contact beams.

The tinned surface of the contact beams renders the connector unreliable for low-current, low-voltage applications which are typical of much of the electronics used in automobiles, such as sensors, computers, and integrated circuits. The tin is susceptible to corrosion, and therefore low-impedance signals are jeopardized by static and discontinuity. Moreover, because the surface area of connectors used for power applications must be large so as to dissipate heat generated by high current, it would be expensive to gold-plate contact beams in an attempt to adapt the connectors to signal-carrying applications. On the other hand, terminals specially designed for transferring low-current signals do not lend themselves to high current applications due to their increased cost and diminished electrical and thermal characteristics when high-current is transferred.

Many prior art pin connectors are not suitable for carrying high current. The hollow neck-down region which provides clearance for a locking finger of the plastic housing is characterized therein by a reduction in material cross-section which proportionally decreases the current-carrying ability of the connector.

Some applications require that both high-current and low-current terminals be used side-by-side in one system. Using different types of connectors or styles of terminals can become costly and complicated. Much confusion results because the connectors may have to be removed from the plastic insulative housings to determine whether they are of the signal-transferring or power-transferring type.

SUMMARY OF THE INVENTION

In surmounting the foregoing disadvantages, the dual usage terminal system of the invention satisfies the demands of both high-current power transfer and low-current signal transfer. At the same time, it is capable of being mounted within existing insulative housings, thereby minimizing the costs associated with specialized low current terminals. The connector employs a first contact zone for signal transfer and a second contact zone for power transfer.

In an exemplary embodiment, a pin-receiving member comprises a pair of opposed tapered contact elements together defining a generally conical shape. Each half-cone contact has a tip with a lead-in operative to mate with a male pin. In signal-carrying applications, a mated pin is engaged by the first contact zone located a first distance past the lead-in. This first contact zone exerts a moderate normal force, and has a contact area preferably shaped as one or more bumps. The bumps are plated with gold. In electric power applications, the pin is moved past the lead-in and first contact zone to engage the second contact zone, which is located a distance of about one-third to one-half the length of the cone from the lead-in. The contact geometry of the power transfer zone is more conducive to high-current transfer because more contact normal force is generated by the shorter length of the opposed, half-cone contact elements. The second contact zone is preferably formed as a pair of semi-circular indentations out of the opposed contacts to provide an annular surface which presents increased contact area. The power contact zone is tin-plated.

The member which connects the pin-receiving member with the wire attachment member is referred to as a neck-down region. In an exemplary embodiment, the neck-down region is preferably tightly rolled or B-crimped so that a cross-section of substantial material contributes to structural strength and high-current capacity.

DESCRIPTION OF THE DRAWINGS

A more thorough understanding of the present invention and attendant features thereof will be more readily understood by reference to the following detailed description when considered with the accompanying drawings, wherein.

DETAILED DESCRIPTION OF THE INVENTION

Figure 1:
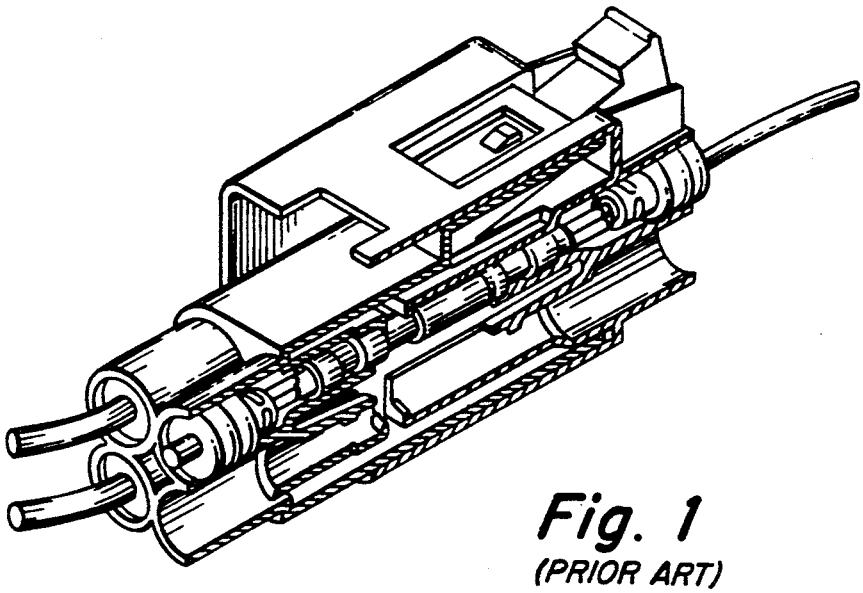
Fig. 1 (PRIOR ART)
FIG. 1 is a sectional view of a prior art pin terminal system wherein a male pin terminal member housed within a protective plastic shell is mated with a pin-receiving terminal member housed within a corresponding shell.
Figure 3:
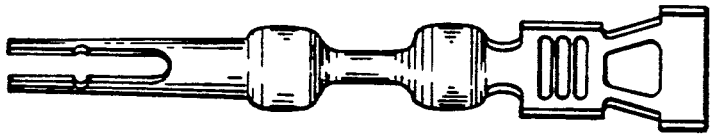
Fig. 3 (PRIOR ART)
FIG. 3 is a top plan view of a prior art pin-receiving member having opposed contact beams, a hollow neck-down region, and crimping tabs for wire and insulation.
Figure 4:
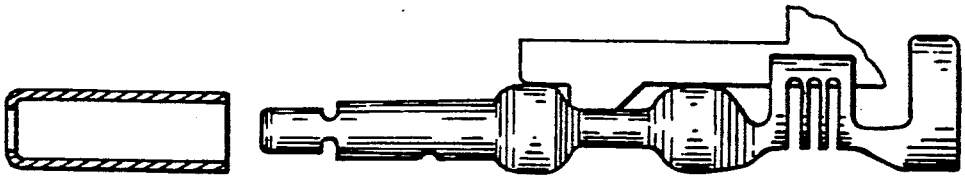
Fig. 4 (PRIOR ART)
FIG. 4 is a side plan view of the prior art terminal of FIG. 3 and a locking finger from a plastic housing.
Figure 2:
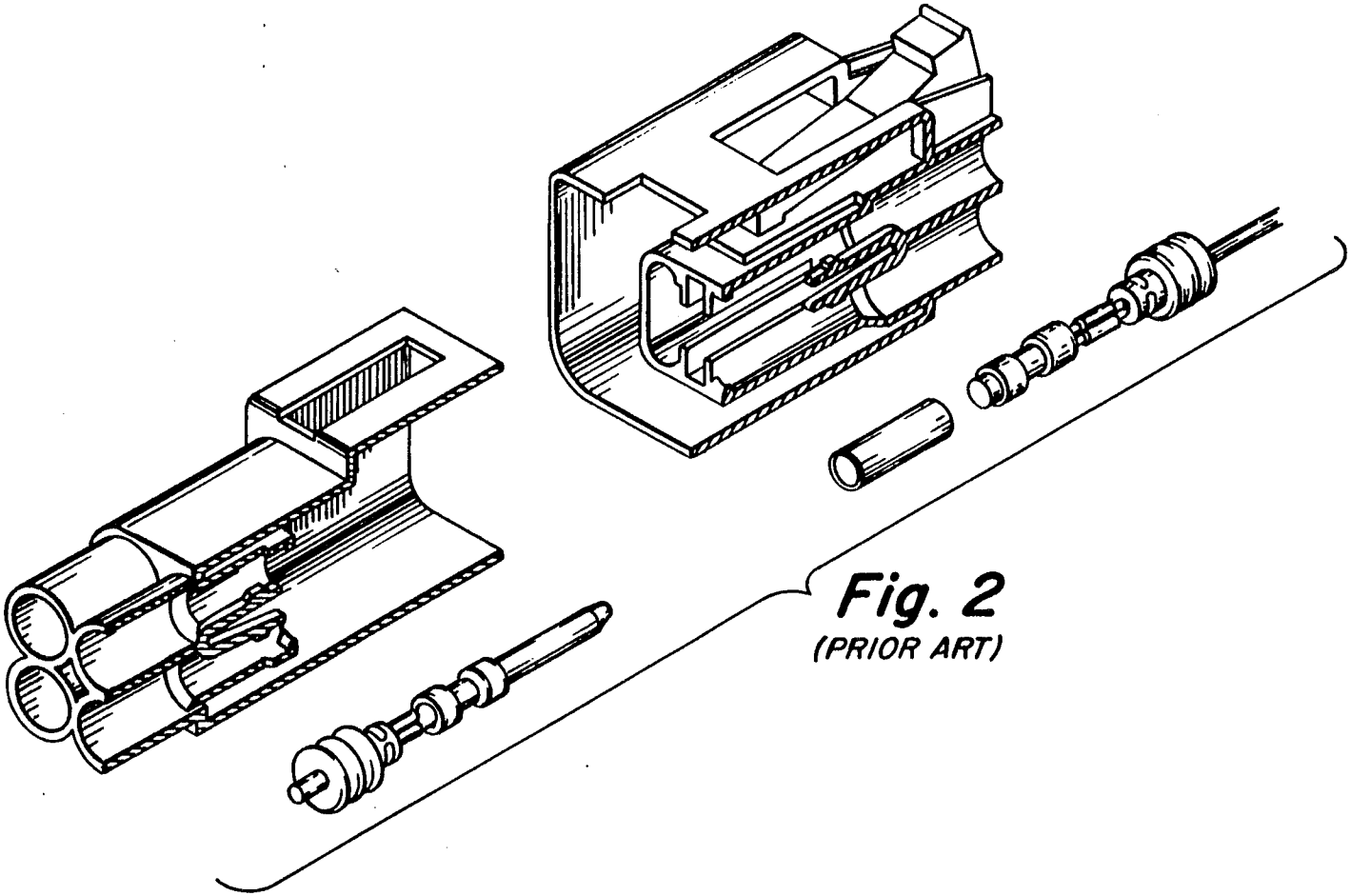
Fig. 2 (PRIOR ART)
FIG. 2 is an exploded view of the prior art terminal system and mateable shells of FIG. 1.

The dual usage electrical/electronic terminal system of the invention provides for low-current signal transferring and high-current power transferring applications. The invention in an exemplary embodiment permits pin and pin-receiving terminal members to be installed in a conventional plastic housing of the type shown in FIGS. 1 and 2 that is commonly used, for example, in automobile wire-harnessing systems.

Figure 5:
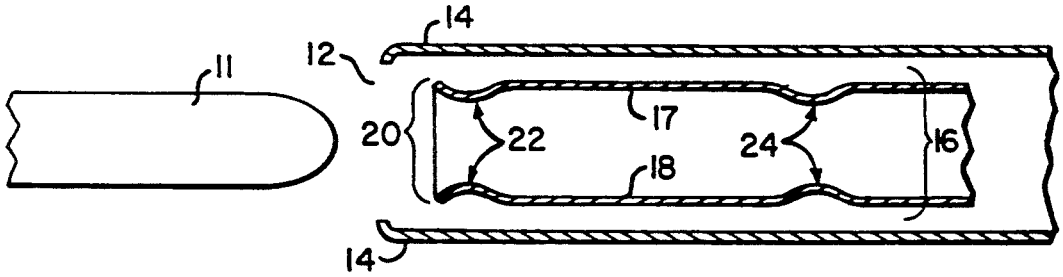
FIGS. 5–7 are illustrations of a male pin contact inserted into pin-receiving contacts of an exemplary pin-receiving terminal member of the invention.
Figure 6:
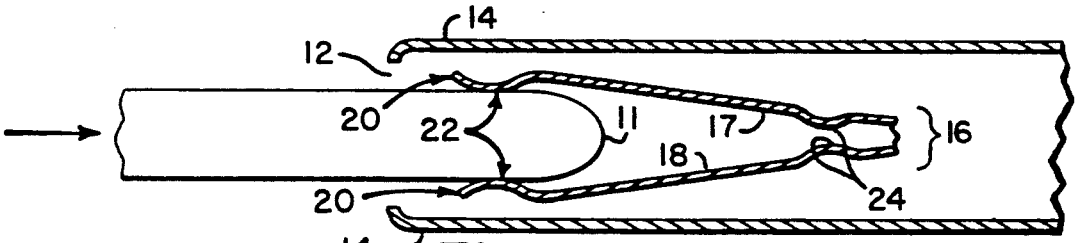
Figure 7:
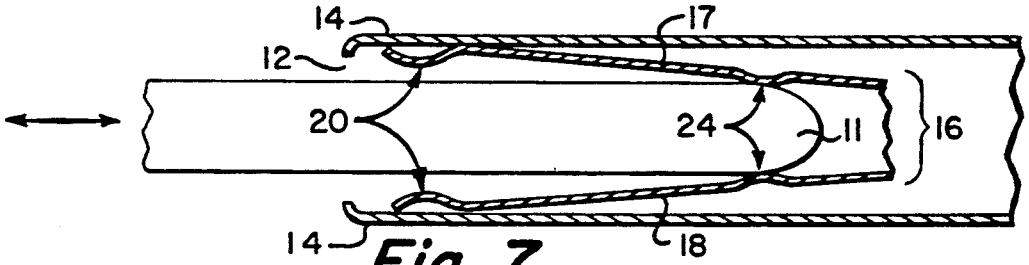

FIGS. 5 through 7 provide a sectional illustration of an exemplary embodiment of the invention in which the head of a male pin 11 contact is inserted through the opening 12 of a shroud tube sleeve 14 which envelopes a pin-receiving contact member 16 comprising a pair of opposed contacts 17 and 18 disposed in a generally cylindrical shape for cooperatively engaging the pin 11. The contacts 17 and 18 are preferably formed out of sheet metal such as copper, aluminum, an alloy thereof such as brass, or other suitable metal. The pin-receiving contact member 16 may comprise more than two contact elements. The contact member 16 may also comprise a slit cylinder comprised of a unitary contact. However, two opposed contact elements 17 and 18 are preferable especially where the pin diameter is small. The opposed contact elements 17 and 18 each comprise a lead-in 20 which can be an opening or an opening having a fluted edge conformed for receiving the head of the male pin 11. The pin-receiving member 16 further comprises a signal transfer zone 22 preferably located a distance from the lead-in 20 and formed out of a bump or indentation in each of the contact members 17 and 18, and a power transfer zone 24 located a further distance beyond the lead-in 20 and signal transfer zone 22. The power transfer zone 24 is shaped from a bump or indentation in the contacts, and preferably has a generally annular cross-shape or other shape which presents increased contact surface area. Numerous contact geometries are contemplated as within the scope of the invention.

As seen in FIG. 5, the pin contact 11 is inserted past the lead-in 20 to engage the contacts 17 and 18 at the signal transfer zone 22. The contacts at this first zone 22 exert a moderate normal force upon the pin contact 11. The area of the signal transfer zone 22 which directly contacts the pin 11 is preferably plated with a noble metal such as gold for improved conductivity and protection from corrosion. In power-carrying applications, a pin contact 11 is inserted past the lead-in 20 and first zone 22 to engage the opposed contacts 17/18 at a power transfer zone 24, which is preferably plated with tin or other inexpensive plating to minimize cost. The power transfer zone 24 is preferably located ⅓ to ½ the length of the contacts 17/18 from the lead-in 20. At this point, a greater normal force is presented for engaging the pin 11 because the flexible length of the contacts 17/18 is shorter. The shroud sleeve 14 protects the contacts 17 and 18 from over-extension. FIG. 7 illustrates the contacts at the lead-in 20 being pushed apart and away from each other when the power transfer zone 24 is engaged with the pin 11.

Figure 8A:
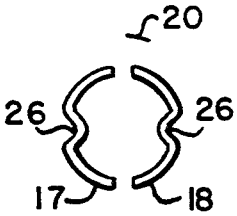
FIGS. 8A–8C are sectional views of the exemplary pin-receiving member of FIG. 8 along, respectively, the signal transfer zone, power transfer zone, and B-crimped neck-down region.
Figure 8B:
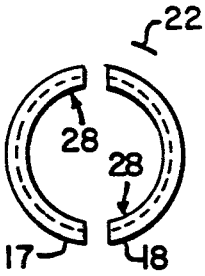
Figure 8C:
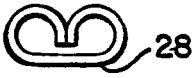
Figure 8:
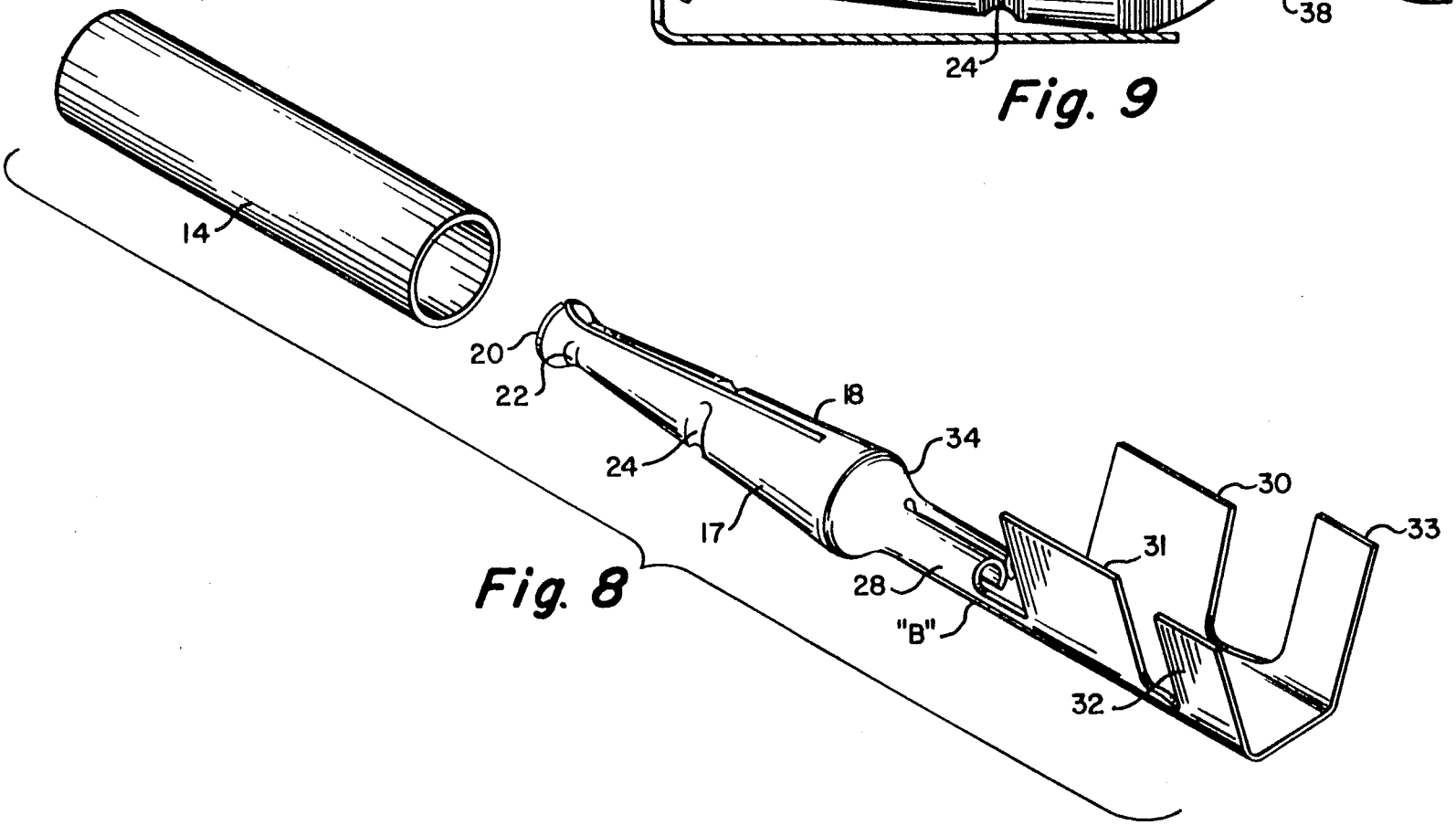
FIG. 8 is an exploded perspective view of an exemplary pin-receiving member of the invention having conical-shaped contacts with signal- and power-carrying zones, a B-crimped neck-down region, a pair of opposed crimping tabs for retaining wire and insulation, and an extended shroud sleeve.

FIG. 8 is an exploded view of the pin-receiving member 10 of the pin terminal system in a further exemplary embodiment wherein the pin-receiving member 10 is comprised of a pair of opposed contacts 17 and 18 shaped so as to form a cone. The contacts may further define a sharp edge 34 operative to improve the retention of the pin-receiving member 10 by a locking finger of a plastic housing. The lead-in 20 is an opening in the pin-receiving contact 16 which receives the pin 11, and it is preferably formed by fluted edges or curled annular flanges. Adjacent to the lead-in is the signal transfer or contact zone 22 which is defined by opposed bumps or indentations 26 as shown by the cross-sectional view of FIG. 8A. The bumps 26 are preferably covered by gold plating. The power transfer or contact zone 24 is formed out of a semi-circular bump, ridge, or indentation 28 in each of the opposed contacts 17 and 18 as shown in the cross-sectional view of FIG. 8A. The contact area of this zone is preferably tin-plated to minimize cost. The neck-down region 28, which electrically connects the pin-receiving contacts 16 with the tabs 30/31 and 32/33, maybe tightly rolled, crimped, or pinched so that it has a substantial cross-sectional shape, such as a "G-shaped" or "swirl-shaped" crimp, or as a "B-shaped" crimp as shown in FIG. 8C. A substantial cross-section improves structural rigidity as well as high current capacity.

Figure 9:
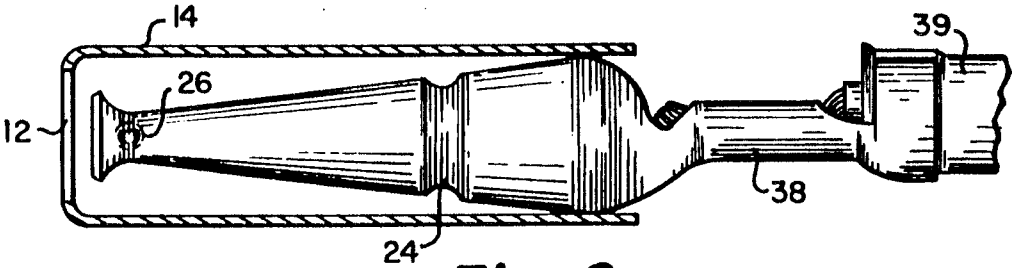
FIG. 9 is an illustration of an exemplary pin-receiving member retained by a locking finger of a plastic housing.

The B-crimped neck-down region 28 in one exemplary embodiment of the invention provides the advantages of added structural strength and improved high-current transfer. An extended shroud tube 14 which has a length sufficient for covering the entire length of the contact members 17 and 18 may be used. The tube, which may be welded or press-fit onto the contacts, is shown abutting a locking finger 36 of a plastic housing in FIG. 9. The crimping tabs 30/31 and 32/33 are shown crimped around wire 38 and insulation 39.

It is contemplated that the locations of the signal transfer zone 22 and power transfer zone 24 are interchangeable. Thus, the signal transfer zone 22 could be located a further distance than the power transfer zone 24 from the lead-in 20. In any event, the contact surface area of the power transfer zone 24 should preferably be large enough to facilitate high current transfer.

Although the word "pin" has been extensively used herein for illustrative purposes, it is further understood that the invention pertains to any male contact which is inserted into a corresponding receptacle contact. Accordingly, the terminal system of the invention pertains to blades, prongs, plugs, card-edges, or other protruding contacts insertable into corresponding receptacle contacts.

It will be known to those of ordinary skill in the art that modifications and variations are possible within the scope of the invention. Accordingly, the scope of the instant invention is limited only by the following claims.

It is claimed:

1. A terminal system for electrical power transfer and electronic signal transfer, comprising:

a contact-receiving member which includes an electrical contact member having a lead-in for surroundably receiving a corresponding electrical contact, a signal transfer zone, for transferring signals between said electrical contact and said contact-receiving member, located a first distance from said lead-in, and a power transfer zone, for transferring power between said electrical contact and said contact receiving member, located a second distance from said lead-in.

2. The terminal system of claim 1 wherein said signal transfer zone is located a shorter distance from said lead-in than said power transfer zone.

3. The terminal system of claim 1 wherein said lead-in, signal transfer zone, and power transfer zone are located linearly with respect to an electrical contact inserted into said contact-receiving member.

4. The terminal system of claim 1 further comprising at least one member operative for attaching wires.

5. The terminal system of claim 1 further comprising at least one crimp tab for attaching wires to said contact member.

6. The terminal system of claim 1 further comprising a neck-down region conformed for cooperative engagement with a locking member of an insulative housing.

7. The terminal system of claim 1 wherein said contact member of said contact-receiving member has a generally cylindrical shape operative to receive a pin.

8. The terminal system of claim 1 wherein said contact member of said contact-receiving member has a generally conical shape operative to receive a pin.

9. The terminal system of claim 1 wherein said contact-receiving member is formed from a sheet of metal.

10. The terminal system of claim 1 wherein said lead-in comprises a fluted edge conformed for receiving the tip of a pin.

11. The terminal system of claim 1 wherein said signal transfer zone is formed from at least one bump in said contacts.

12. The terminal system of claim 1 wherein said power transfer zone is formed from an annular indentation.

13. The terminal system of claim 1 wherein said signal transfer zone is plated with a noble metal.

14. The terminal system of claim 1 wherein said signal transfer zone is gold-plated.

15. The terminal system of claim 1 wherein said power transfer zone is plated in tin.

16. The terminal system of claim 1 wherein said contact-receiving member is covered with a tube which covers the entire length of said contact member.

17. The terminal system of claim 1 wherein said contact member has a sharp edge to allow said contact-receiving member to be retained by a locking member in a housing.

18. The terminal system of claim 1 wherein when said power transfer zone touches said electrical contact, said signal transfer zone does not touch said electrical contact, and when said signal transfer zone touches said electrical contact, said power transfer zone does not touch said electrical contact.

19. The terminal system of claim 1 further comprising at least one member for attaching wires and a connecting member for electrically connecting said wire-attaching member to said contact member.

20. The terminal system of claim 19 wherein said connecting member is formed to provide a cross-section characterized by structural rigidity and high current capacity.

21. The terminal system of claim 19 wherein said connecting member has a B-shaped crimp.

22. A terminal system for electrical power transfer and electronic signal transfer, comprising:

a contact-receiving member which includes an electrical contact member having a lead-in for receiving a corresponding electrical contact, a signal transfer zone, for transferring signals between said electrical contact and said contact-receiving member, located a first distance from said lead-in, and a power transfer zone, for transferring power between said electrical contact and said contact receiving member, located a second distance from said lead-in.

* * * * *